US005799905A

United States Patent [19]

Rokita

[11] Patent Number: 5,799,905

[45] Date of Patent: Sep. 1, 1998

[54] APPARATUS AND METHOD FOR ATTACHING GUTTERS TO STRUCTURES

[76] Inventor: Stephen R. Rokita, P.O. Box 100, Sussex, N.J. 07461

[21] Appl. No.: 600,443

[22] Filed: Feb. 13, 1996

[51] Int. Cl.[6] ..... E04D 13/072

[52] U.S. Cl. ..... 248/48.2; 248/547; 52/11

[58] Field of Search ..... 411/525, 526, 411/527, 437; 52/11; 248/48.2, 48.1, 547, 216.1, 916

[56] References Cited

U.S. PATENT DOCUMENTS

| | | | |
|---|---|---|---|
| 1,023,456 | 4/1912 | Callahan | 248/48.2 |
| 2,064,091 | 12/1936 | Tinnerman | 411/527 |
| 2,355,486 | 8/1944 | Tinnerman | 411/437 X |
| 2,393,030 | 1/1946 | Eggert | 411/526 |
| 2,410,968 | 11/1946 | Eggert | 411/527 X |
| 2,733,629 | 2/1956 | Vogt | 248/48.1 X |
| 3,416,760 | 12/1968 | Sauder | 248/48.2 |

OTHER PUBLICATIONS

Two pages and cover page from Jul. 31, 1991 SBH catalog showing a variety of push nuts.

One page and cover page from a 1997 Servalite catalog showing a variety of push nuts.

Product Literature for Gutter-Lok™, from SFS, undated.

*Primary Examiner*—Robert W. Gibson, Jr.
*Assistant Examiner*—Stephen S. Wentsler
*Attorney, Agent, or Firm*—Glen M. Diehl

[57] ABSTRACT

Apparatus and method for attaching gutters to structures such as houses are disclosed. The apparatus includes a bracket having a push nut which is either an integral part of the bracket or an external component that is attached to the bracket. A spike is driven through the part of the gutter that normally holds the spike, through the push nut section of the bracket and into the house. The bracket is attached to the house via fastening devices such as screws. The apparatus provides a convenient means of repairing loosened gutters and for a superior way to install new gutters.

6 Claims, 2 Drawing Sheets

APPARATUS AND METHOD FOR ATTACHING GUTTERS TO STRUCTURES

BACKGROUND OF THE INVENTION

The present invention relates to gutters. More specifically, it relates to apparatus and methods for attaching gutters to structures such as houses.

It is well known that gutters are attached to houses to guide water from rainfall away from the houses. The gutters are sloped toward drain pipes so that the collected water runs down the drain pipe. The gutters are typically attached to the house with a spike which is driven through a hole in the gutter structure into a side board in the house. The spikes, however, often work loose so that they no longer hold the gutter properly in place. This causes the gutters to loosen so that in areas they loose their slope toward the drain pipe and the gutters no longer function properly. Eventually, the gutters fail completely.

Thus, new apparatus and methods for attaching and for reattaching gutters to houses are needed.

SUMMARY OF THE INVENTION

In accordance with the present invention, apparatus and method for attaching gutters to structures, such as houses, are provided. The attaching apparatus includes a bracket with a push nut. The push nut is either an integral part of the bracket or an attached component. The apparatus includes one or more fastening devices which are used to attach the bracket to the house. For example, two screws can be used. In accordance with the method of the present invention, the bracket is attached to the house with the screws and then a spike is driven through a section of the gutter that is adapted to receive the spike and then through the push nut section of the bracket and into the house.

The apparatus of the present invention can be provided in kit form for repair of existing gutter installations. For the kit, it is preferred to provide the bracket having a push nut and the means for fastening the bracket to the gutter and the house. In this case, the existing spike that has become loosened is used along with the bracket to make an installation. Alternatively, a new spike can also be provided, thereby ensuring a snug fit with the push nut in the bracket. The apparatus of the present invention can also be provided with gutters so that the bracket is installed during the original installation of the gutter.

The invention will now be further described in connection with certain illustrated embodiments; however, it should be clear to those skilled in the art that various modifications, additions and subtractions can be made without departing from the spirit and scope of the claims.

DESCRIPTION OF THE PREFERRED EMBODIMENT

Figure 1:
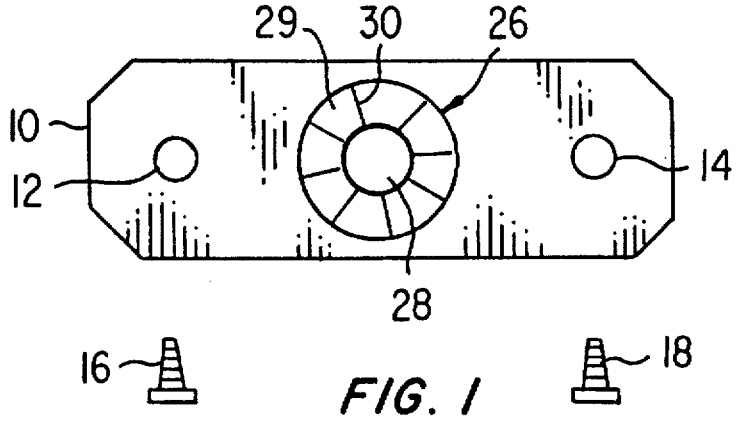
FIG. 1 illustrates the gutter attachment components in accordance with a preferred embodiment of the present invention.

In FIG. 1, a bracket 10 for attaching gutters to structures, such as houses, is shown. The bracket 10 is preferably approximately two inches long and ¾ inches wide, although any size can be used. The bracket 10 is also preferably made from a noncorrosive material. For example, plated steel, stainless steel, aluminum or plastic can be used. It is preferred, however, to use a metal, such as plated steel or stainless steel.

The bracket 10 includes two holes 12 and 14. These holes 12 and 14 are sized so that two screws 16 and 18, respectively, can fit into the holes. The screws 16 and 18 are used to secure the bracket 10 to a house or other structure. Other fastening devices can be used in place of the screws 16 and 18. For example, nails or rivets can be used.

The bracket 10 also includes a push nut section 26, preferably located in the center of the bracket 10. The push nut section 26 has a hole in the center which is preferably sized to accept a spike which is normally used to attach gutters to houses. The push nut section 26 operates to keep the spike secure once the spike enters the hole in the push nut section 26. Thus, the push nut section 26 operates in a fashion similar to other push nuts. See, for example, the operation of the push nut having part number PBR-14 available from the Servolite Co.

The push nut section 26 can be and is preferably formed integrally with the bracket 10, particularly if the bracket 10 is made from a metal, such as plated steel, stainless steel or aluminum. In one preferred production process, a piece of spring steel coil stock is cut to an appropriate size to form the bracket 10. Then progressive stamping dies first punch out the holes 12 and 14. Next, the progressive stamping dies stamp a hole 28 in the center of the bracket 10 forming an indentation in the bracket 10 and then the progressive stamping dies form tabs 29 by stamping radially out from the hole 28, along the lines 30. After the holes and the push nut section are formed, the bracket 10 is preferably tempered. Next, the bracket 10 is preferably plated, for example, with galvanized zinc.

Figure 2:
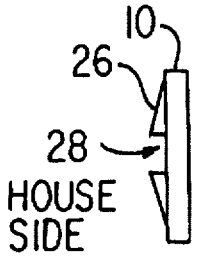
FIG. 2 illustrates a side view of a bracket of FIG. 1.

In FIG. 2, a side view of the bracket 10 is shown. In this view, it is seen that the push nut section 26 section is pushed outward during the stamping process. The hole 28 is in the middle of the bracket 10. When a spike, which is normally used to secure a gutter to a house, is inserted in the hole 28, the push nut section 26 grabs the spike to firmly hold it in place.

In an alternate embodiment, the push nut section 26 can also be a separate component which is attached to the bracket 10. For example, a push nut similar to the one available from Servolite, having part number PBR-14, could be used. This is a circular push nut having a round opening in the center. Alternatively, a push nut having a different configuration, such as the rectangular configuration found on the Servolite push nut having part number PN-XN, can be used.

In either case, the Servolite push nut would have to be resized to accept a gutter spike and the tabs may have to be strengthened to withstand greater forces. The push nut 26 would then be attached to the bracket 10 by soldering, brazing or any other attachment methodology. The push nut 20 operates the same whether it is an integral component or a separate component in that it operates to firmly and securely hold a spike in place.

Figure 3:
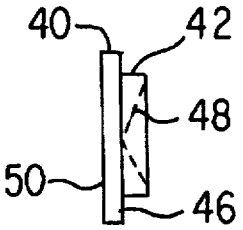
FIG. 3 illustrates an alternate embodiment of a bracket useful in the present invention.

FIG. 3 shows the alternate embodiment of the bracket of the present invention. In FIG. 3, the bracket 40 is preferably formed from stainless steel. A push nut 42 is attached to one side 46 of the bracket 40. The tabs 48 that grab the spike extend inward toward the side 50 of the bracket 40. The side 50 is intended to mount closest to the house or other structure.

Figure 5:
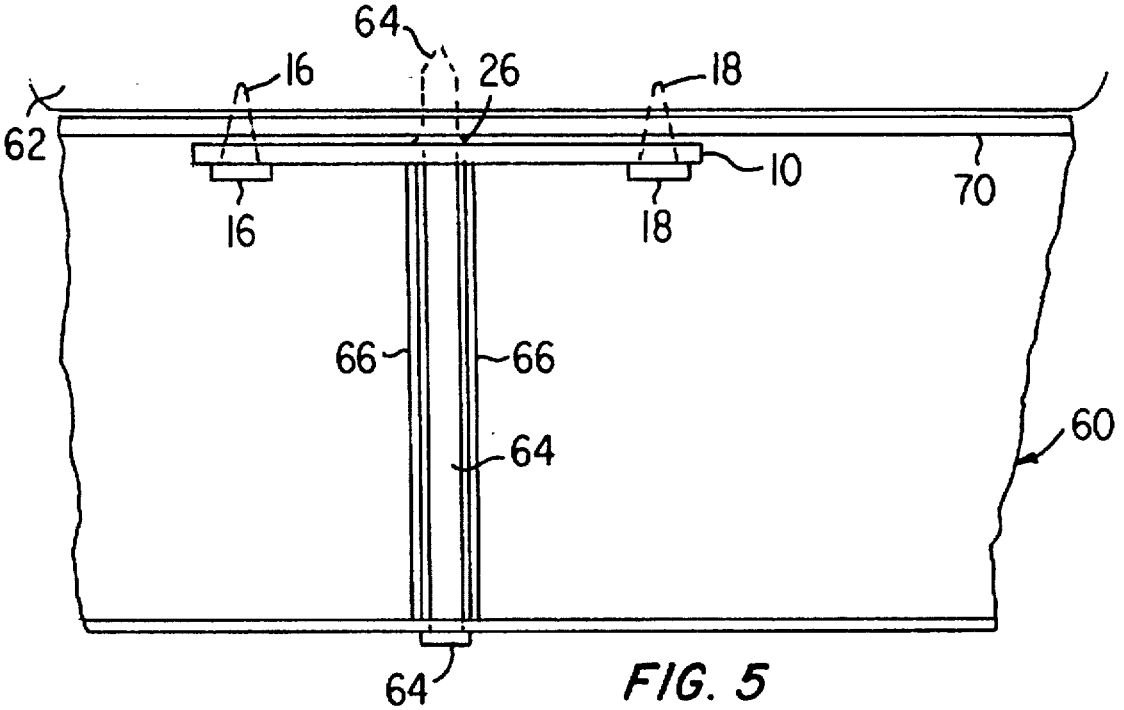
FIG. 5 shows a top view of a gutter attached to a house in accordance with the present invention.
Figure 4:
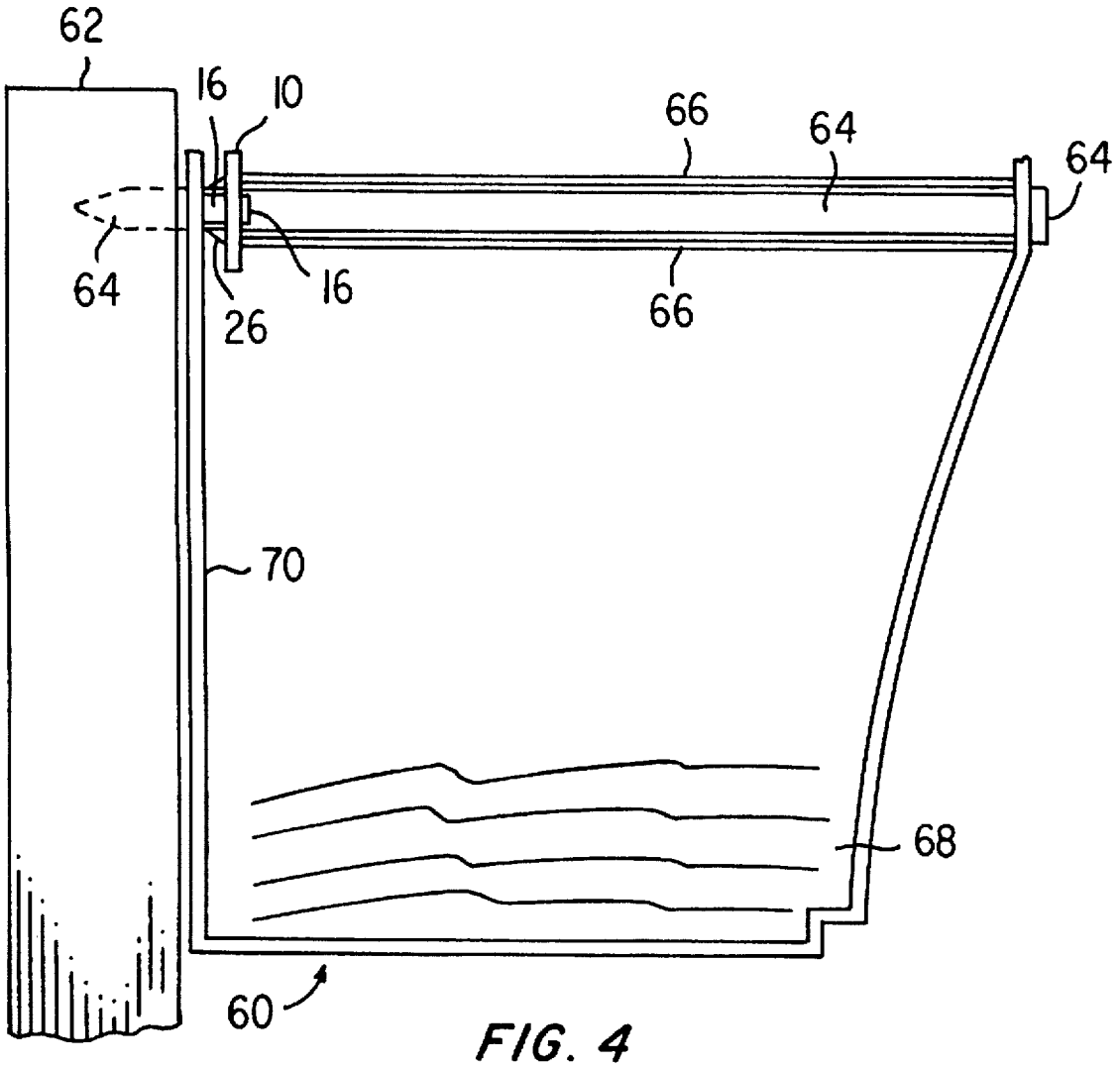
FIG. 4 illustrates a sectional view of a gutter attached to a house in accordance with the present invention.

In FIGS. 4 and 5, a gutter 60 is shown attached to a facie board 62 of a house. Normally, the gutter 60 is secured to the board 62 by a spike 64 which is driven through holes in the gutter 60 and into the board 62. Ordinarily, the spike 64 is surrounded by a cylindrical tube 66. The tube 66 reinforces the gutter so the spike goes in so far and keeps the gutter from collapsing or being crushed. As ice formations, weight from snow and other debris 68 accumulates in the gutter 60, and as winds and weak wood take effect, the spike 64 often loosens from the board 62 and gutter 60 sections often sag. When this happens the gutter 60 sags and becomes non-functional.

In accordance with the present invention, to remedy this situation, the spike 64 is removed from the facie board 62. The bracket 10 is placed on the exposed side of the inside part of the gutter 60 so that the spike 64 can be driven through the push nut section 26 of the bracket 10 and back into the existing hole in the facie board 62. Self tapping screws 16 and 18 are preferably inserted into the holes 12 and 14, respectively, and then driven into a rear wall 70 of the gutter 60. Alternatively, if self-tapping screws are not used, then holes can be drilled into the gutter 60 and the facie board 62 before insertion of the screws 16 and 18. Note that FIGS. 4 and 5 are illustrative only. For example, while a space is indicated between the bracket 10 and the gutter 60, the bracket 10 would normally be held against the gutter 60

The bracket 10 can be used in different ways to attach the gutter 60 to the house 62. For example, in FIGS. 4 and 5 the bracket 10 is shown outside the rear wall 70 of the gutter 60. The bracket 10, in an alternate embodiment, can also be positioned between the rear wall 70 of the gutter 60 and the house 62. The configuration of FIGS. 4 and 5, however, is preferred.

The attachment apparatus and method of the present invention, therefore, provides an effective means for repairing gutters that have come loose. The present invention also provides an effective attachment apparatus and method for new gutters.

It is understood that changes may be made in the above description without departing from the scope of the invention. It is accordingly intended that all matter contained in the above description and in the drawings be interpreted as illustrative rather than limiting.

I claim:

1. A drainage apparatus for a structure, comprising:

a spike;

a gutter, the gutter having a hole through which the spike is inserted;

a bracket positioned on the gutter such that the bracket is adapted to be attached to the structure through the gutter, the bracket having a push nut section through which the spike is driven, the push nut section firmly holding the spike in place; and fastening means for attaching the bracket to the house.

2. The drainage apparatus of claim 1, wherein the push nut section is an integral part of the bracket.

3. The drainage apparatus of claim 1, wherein the push nut section is a component attached to the bracket.

4. The drainage apparatus of claim 3, wherein the push nut section is attached to the bracket on the opposite side of the bracket that is attached to the structure.

5. The drainage apparatus of claim 1, wherein the spike is capable of being driven into the structure.

6. A method of attaching a gutter to a structure with a spike, comprising the steps of:

positioning a bracket with an open push nut section on the gutter such that the spike can be driven first through the open push nut section, then through the gutter and then through the structure;

driving the spike first through the open push nut section, then through the gutter and then into the structure; and securing the bracket through the gutter and into the structure.

* * * * *